United States Patent [19]

Norris et al.

[11] Patent Number: 4,589,752

[45] Date of Patent: May 20, 1986

[54] FILM PROCESSOR WITH S-CURVE FLUID APPLICATOR PAD

[75] Inventors: Philip R. Norris, North Reading; Vincent L. Cocco, Wakefield, both of Mass.

[73] Assignee: Polaroid Corporation, Cambridge, Mass.

[21] Appl. No.: 685,852

[22] Filed: Dec. 24, 1984

[51] Int. Cl.[4] ..... G03D 3/12; G03D 5/06

[52] U.S. Cl. ..... 354/303; 354/318

[58] Field of Search ..... 354/302, 303, 305, 318, 354/319, 320, 321

[56] References Cited

U.S. PATENT DOCUMENTS

| | | | |
|---|---|---|---|
| 3,640,204 | 5/1970 | Gordon | 354/318 |
| 4,309,100 | 1/1982 | Bendoni et al. | 354/303 |
| 4,435,062 | 3/1984 | Cocco | 354/303 |
| 4,443,530 | 4/1984 | Cronin et al. | 354/303 |
| 4,469,425 | 9/1984 | Cocco et al. | 354/310 |
| 4,519,689 | 5/1985 | Kinsman et al. | 354/318 |
| 4,523,825 | 6/1985 | Norris | 354/318 |
| 4,540,263 | 9/1985 | Kramer | 354/318 |

*Primary Examiner*—A. A. Mathews

*Attorney, Agent, or Firm*—John J. Kelleher

[57] ABSTRACT

Film processing apparatus is provided for uniformly spreading processing fluid on a surface of a sheet of photosensitive material with an applicator pad in the form of a length of absorbent web material impregnated with processing liquid and wrapped on a pair of rollers with each end thereof being attached to a respective one of the rollers forming the roller pair. The applicator material is wrapped on both of the rollers with the applicator material and the roller pair being enclosed in a liquid-tight housing having a self-sealing opening therein for the passage of photosensitive sheet material therethrough. An exposed sheet of photosensitive material is transported from a light-tight cassette through the self-sealing housing opening and into the bite between wrapped and unwrapped applicator pad surfaces. A drive motor drives the pair of rollers such that in one direction the entire photosensitive sheet is drawn in between adjacent layers of wrapped applicator material where it imbibes processing liquid from the applicator pad for a predetermined period of time. Upon completion of the imbibition, the rollers are then driven in the opposite direction until the imbibed sheet is driven out of the processing apparatus by the drive motor through the self-sealing housing opening.

12 Claims, 6 Drawing Figures

FILM PROCESSOR WITH S-CURVE FLUID APPLICATOR PAD

BACKGROUND OF THE INVENTION

The present invention relates to apparatus for applying a liquid to a sheet of material, in general, and to such apparatus for applying a liquid developer to a surface of a film unit or sheet of photosensitive material, in particular.

The use of small volumes of processing liquids has become particularly important in connection with instant image processes where image development is carried out immediately after exposure of a photographic film or immediately after a previously exposed film is withdrawn from a light-tight cassette and where small volumes of processing liquids must be employed for proper image development. If an excessive amount of processing liquid is applied to a sheet of photosensitive material in such circumstances, it will produce an undesirable or negative effect on overall image quality.

Instant image processing is very often accomplished by squeezing a processing fluid out of a rupturable container or pod by drawing the processing fluid containing pod between a pair of adjacent pod-rupturing and fluid-spreading rollers. After the pod has been so ruptured, its contents are squeezed out and then evenly spread between adjacent photographic film layers for film developing purposes. This type of spread system is capable of accurately spreading a fairly precise thickness of developer fluid between such adjacent layers for proper image development. However, a spread system of this type is relatively expensive because it requires the use of precisely dimensioned spread control components (e.g., precision rollers) in order to achieve such fluid-thickness distribution.

In another presently available spread system, processing fluid is applied to a surface of a sheet of photosensitive material by means of a pad-type liquid applicator. Processing fluid spreading is accomplished by establishing contact between a coated surface of the photosensitive material and a spreading element or applicator pad consisting of any of a variety of flat, porous capillary action materials impregnated with processing fluid. These fluid-spreading elements are porous structures in the form of individual sheets which may be woven or non-woven webs of paper, porous plastic or metal layers, sponge or foam-like material or hydrophillic material if an aqueous processing fluid is employed. The fluid-spreading element may be presoaked with sufficient liquid to process a single photosensitive sheet or may be provided in combination with a container of liquid that serves as a reservoir for providing additional liquid when the required volume of liquid for complete processing exceeds the liquid holding capacity of the fluid spreading element.

An applicator pad processing liquid spread system is less costly than the spread roller spread system mentioned above primarily because of the absence of the need for precisely dimensioned components that are relatively expensive to manufacture. However, applicator pad spread systems often require the use of squeegee-like devices to insure complete contact between the pad and the surface of the sheet of material to be coated. In addition, applicator pad type spread systems tend to be bulky and as presently constructed are incapable of simultaneously spreading process fluid on both sides of a sheet of photosensitive material.

A primary object of the present invention, therefore, is to provide a method and apparatus for simultaneously coating both sides of a film unit or sheet of photosensitive material.

Another object of the present invention is to provide a method and apparatus for readily coating the surface of a series of individual sheets of photosensitive material.

Yet another object of the present invention is to provide a method and apparatus for insuring complete contact between a fluid-spreading applicator pad and a coated surface of a sheet of photosensitive material.

A further object of the present invention is to provide a portable applicator pad type processing fluid spread system of minimum size.

Other objects, features and advantages of the present invention will be readily apparent from the following detailed description of the preferred embodiment thereof, taken in conjunction with the accompanying drawings.

SUMMARY OF THE INVENTION

In accordance with the present invention, a method and apparatus are provided for uniformly applying processing fluid to one or more surfaces of one or more film units or sheets of photosensitive material by means of a fluid-retaining applicator pad. The method and apparatus comprises an applicator pad in the form of a length of absorbent web material impregnated with processing liquid and wrapped on a pair of rotatably mounted rollers. Each end of the length of said web material is attached to a respective one of the rollers forming said roller pair. The applicator and roller pair are enclosed in a housing having an opening therein for the passage of a film unit therethrough. An exposed film unit is transported from a light-tight cassette through said housing opening and into the bite between wrapped and unwrapped applicator pad surfaces. A drive motor drives said pair of rollers in one direction until the entire film unit is positioned between adjacent layers of wrapped applicator pad material by such roller movement. The drive motor subsequently drives said rollers in a reverse direction, causing said film unit to be transported out of said housing through said housing opening after sufficient time has elapsed for an adequate quantity of processing fluid to be imbibed by said film unit.

FIGS. *2a–2d* are a set of schematic diagrams illustrating the preferred liquid-applicating sequence of operation of the film processing apparatus of the present invention.

Figure 3:
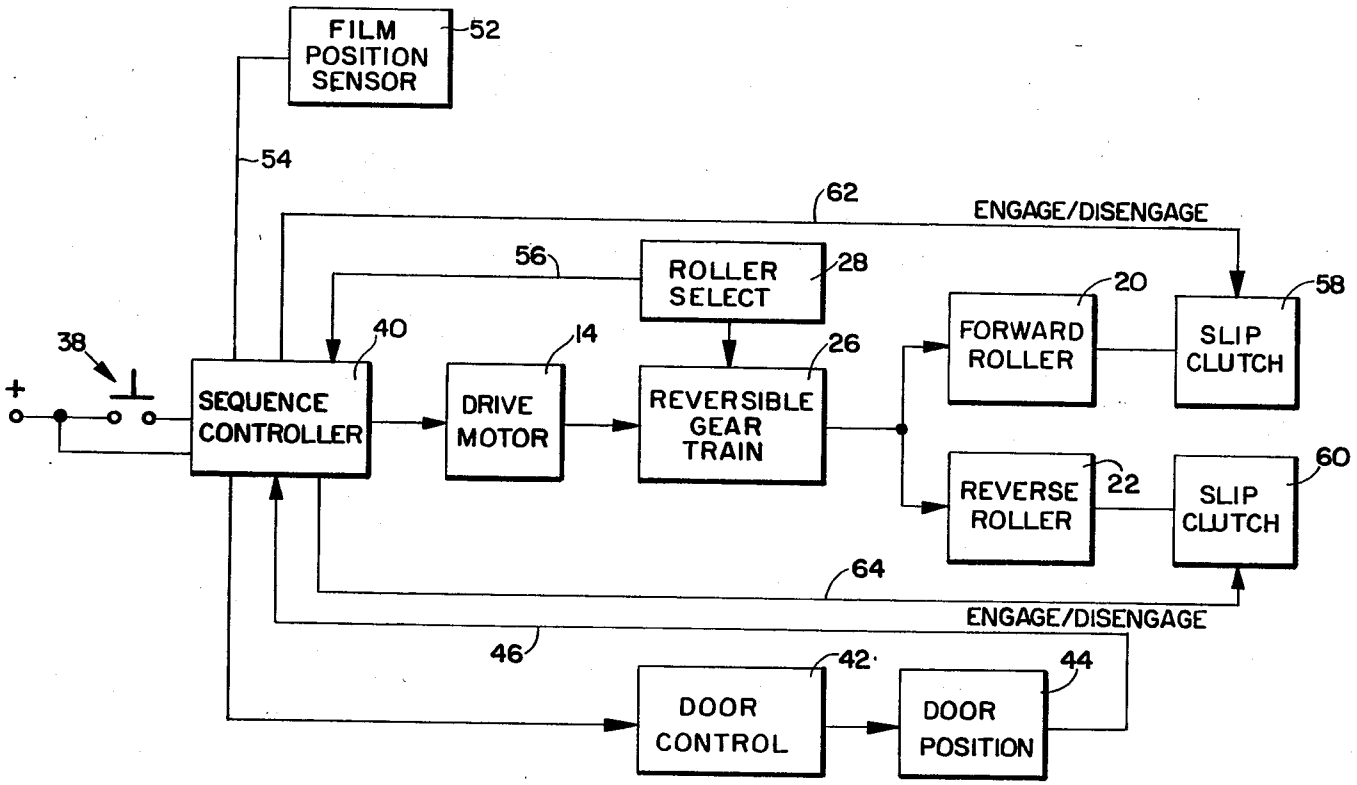

FIG. 3 is a signal flow block diagram of a preferred embodiment of the film processing apparatus control system of the present invention.

DESCRIPTION OF THE PREFERRED EMBODIMENTS

Figure 1:
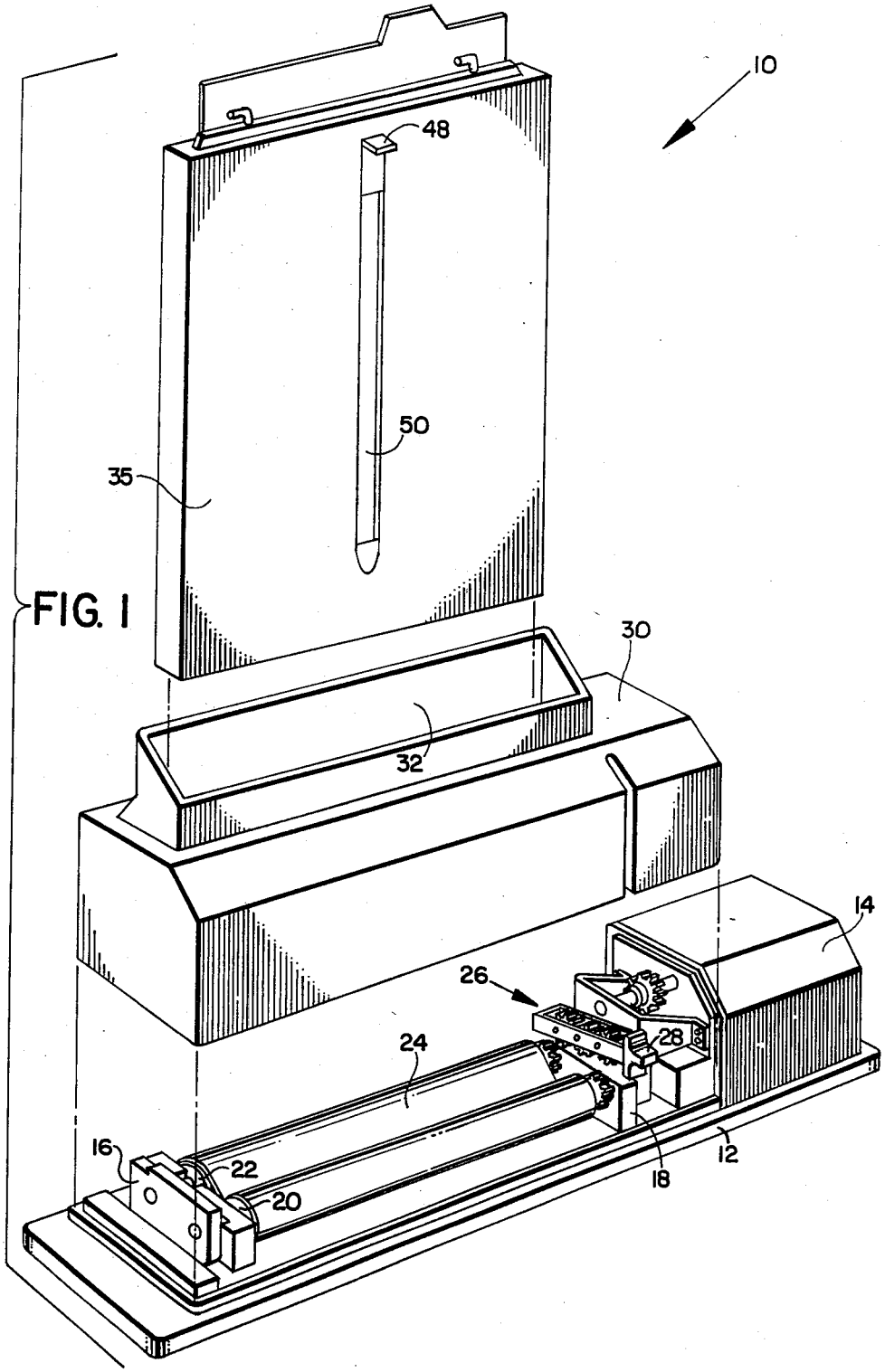
FIG. 1 is an exploded perspective view of a preferred embodiment of the liquid applicator apparatus of the present invention.

Referring now to the drawings, in FIG. 1, an exploded perspective view of a preferred embodiment of liquid applicator apparatus 10 of the present invention, is depicted. Liquid applicator apparatus 10 includes rectangular housing base member 12 having electric drive motor 14 mounted in a fixed relation on top of and at one end thereof. In addition, bearing support members 16 and 18 are also mounted on top of housing base member 12 in a fixed relation. Bearing support member 16 is mounted on one end of base member 12 opposite from the end supporting drive motor 14 and bearing support 18 is mounted in an intermediate position between bearing support member 16 and said drive motor 14. The opposite ends of spaced apart cylindrical rollers 20 and 22 are rotatably supported by bearing support members 16 and 18, respectively, and are spaced from and disposed in substantially parallel alignment with one another.

Rollers 20 and 22 are coupled to separate conventional electrically actuatable slip clutches (not shown) that are selectively operable between engaged and disengaged positions. In the engaged position, rotational motion retarding frictional forces are coupled to rollers 20 and 22 through their associated slip clutch. These motion-retarding frictional forces are removed from said rollers whenever their associated slip clutch is actuated to its disengaged position. A length of web in the form of absorbent pad-type liquid applicator 24 is firmly wrapped on each of said rollers 20, 22 with each end thereof being attached to a respective one of said rollers 20 or 22 with most of said applicator pad being wrapped on roller 20. Applicator pad 24 may be fabricated from any number of suitable liquid-absorbing materials, but is preferably made of polypropylene.

Reversible gear train 26 selectively and alternately couples rotational forces generated by drive motor 14 to either roller 20 or roller 22. Roller rotational-motion selecting lever 28 is manually movable between two alternate vertical positions. In the upper position, as shown in drawing FIG. 1, roller 20 is rotated in a predetermined direction by drive motor 14 causing applicator pad 24 to be unwrapped from roller 22 and subsequently wrapped onto said roller 20. Conversely, when lever 28 is manually placed in its alternate or lower position, roller 22 is rotated in the same direction as roller 20, thereby causing applicator pad 24 to be unwrapped from roller 20 and subsequently wrapped onto roller 22.

Housing cover 30 having sealable opening 32 projecting through the top surface thereof has its bottom portion adapted to cooperatively engage housing base member 12. When housing cover 30 is fully assembled on housing base member 12, rollers 20, 22 and web applicator 24 are enclosed within said cover 30 in a liquid-tight enclosure. Pivotably mounted liquid-tight seal forming door 33 (FIGS. *2a–2d*) at the bottom of said opening 32 is electrically actuatable between its fully opened and fully closed or sealed positions. After housing member cover 30 has been positioned on housing base member 12 in a liquid-tight relation, processing fluid 34 is then poured into the space enclosed by said base member 12 and said housing cover 30 until the level of said fluid 34 is in contact with at least a portion of web applicator 24. When fluid 34 contacts a portion of web applicator 24, wicking or liquid-absorbing action causes said fluid 34 to be fairly uniformly distributed throughout said web applicator 24. This assembled, liquid-tight enclosure including said liquid-tight seal-forming door 33 is schematically shown in drawing FIGS. *2a–2d*.

Figures 2A, 2B, 2C, 2D:
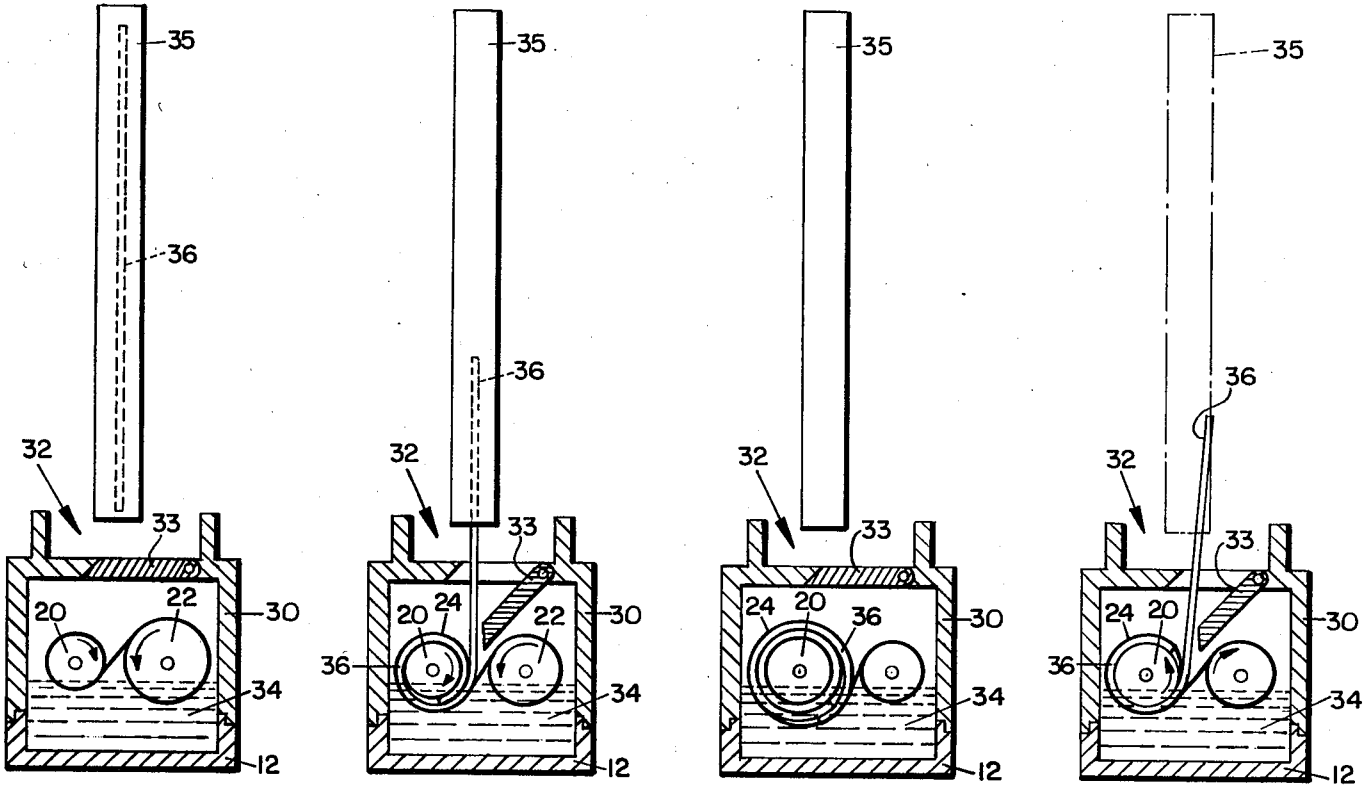

Processing of a sheet of photosensitive material is accomplished in the following manner. With reference to FIGS. 1–3 of the drawings, light-tight cassette 35 contains film unit or sheet of photosensitive material 36, the film unit to be processed by fluid applicator apparatus 10 of the present invention. The bottom end of said cassette 35 is fully inserted into opening 32 in housing cover 30. The processing of film unit 36 is initiated by momentarily actuating switch 38 (FIG. 3) to its fully closed position. When switch 38 is so actuated, sequence controller 40 causes door control actuator 42 to rotate door 33 in opening 32 of housing cover 30 to its full open position. This full open position of door 33 is sensed by door position sensor 44 and a signal representative of this position is routed to sequence controller 40 through path 46.

Previously exposed film unit 36 is then transferred from cassette 35 to within housing cover 30 for processing without further exposure to image-degrading ambient light. Film unit 36 is moved within housing cover 30 by manually sliding film unit 36 engaging tab 48 along slot 50 formed in an outer surface of cassette 35. This sliding movement of tab 48 causes the end of film unit 36 to move through door 33 and into engagement with applicator pad 24 in the bite between an unwrapped applicator pad portion between rollers 20, 22 and the larger portion of applicator pad 24 wound on said roller 20. The opening of door 33 and the subsequent engagement of the end of film unit 36 with applicator pad 24 are schematically shown in drawng FIGS. *2a* and *2b*, respectively.

When film unit 36 is in proper positional engagement with applicator pad 24, as sensed by film unit position sensor 52, a signal representative of this position is routed to sequence controller 40 through path 54. Upon receipt of this film unit position signal from sensor 52, sequence controller 40 energizes drive motor 14. The rotational motion produced by drive motor 14 is directly coupled to either forward roller 20 or reverse roller 22 through reversible gear train 26. The position of roller select lever 28 determines which of said rollers 20, 22 is to be directly driven by said drive motor 14. Select lever 28 is placed in its uppermost position as shown in drawing FIG. 1 which causes the rotational motion of drive motor 14 to be directly coupled to forward roller 20. When roller 20 is rotated by drive motor 14, the rest of film unit 36 is withdrawn from cassette 35 and wrapped onto roller 20 between adjacent layers of applicator pad 24.

After sheet 36 has been withdrawn from cassette 35 and fully wrapped on forward roller 20 between adjacent applicator pad 24 layers, sequence controller 40 causes door control actuator 42 to rotate door 33 to its fully closed position as shown in drawing FIG. *2c*. Processing fluid impregnated in applicator pad 24 is transferred to or imbibed by both surfaces of film unit 36 by virtue of the close intimate contact bewteen said applicator pad 24 and said film unit 36. A part of applicator 24 is immersed in processing fluid 34 as previously noted and therefore, as the amount of fluid in applicator 24 is reduced by the film unit fluid application process, this fluid is replaced by the wicking action of applicator pad 24 that is partially immersed in said fluid 34.

Upon completion of the imbibition period or the time required for the proper amount of processing fluid to be absorbed by the coated surfaces of film unit 36, empty cassette 35 is removed from opening 32 in housing cover 30 and then lever 28 is placed in its lower position. When lever 28 is placed in its lower position, a lever 28 position signal is transmitted to sequence controller 40 through path 56. The receipt of the lever 28 position signal causes sequence controller 40 to energize drive motor 14 and to actuate door control actuator 42 such that door 33 is rotated to its full open position. The rotational motion produced by drive motor 14 is coupled to reverse roller 22 through gear train 26. When roller 22 is so rotated by drive motor 14, the now processed film unit 36 is unwrapped from roller 20 and transported out of housing cover 30 through door 33. Door 33 acts as a mechanical guide for moving sheet 36 when in its open position. Sequence controller 40 subsequently causes door control actuator 42 to rotate door 33 to its fully closed position after imbibed film unit 36 has been transported through said door 33. The above sequence is repeated for subsequent film units.

The extent of rotational movement of rollers 20 and 22 by drive motor 14 for the movement of a film unit out of cassette 35 and in between adjacent layers of applicator pad 24 for film unit processing purposes is primarily dependent upon the length of said film unit 36 in the direction of film unit movement. The longer the film unit, the greater the extent of the rotation of rollers 20 and 22 by drive motor 14. Sequence controller 40 is preprogrammed for the appropriate length of drive motor 14 drive time for the particular length of film unit to be processed. In addition, the extent of applicator pad 24 movement is also determined by the number of film units that are processed. After a predetermined number of film units have been processed by applicator pad 24, a length of applicator pad slightly larger than the length of the film unit being processed is unwrapped from roller 20 and then wrapped onto roller 22. By moving a length of applicator material from roller 20 to roller 22, a fresh or uncontaminated portion of applicator pad 24 is made available for maintaining processing-liquid application quality. The frequency and extent of applicator pad 24 movement for the purpose of uncovering a fresh or uncontaminated applicator pad portion is also preprogrammed within sequence controller 40.

Forward and reverse rollers 20 and 22 have friction-load providing slip clutches 58 or 60 respectively coupled thereto. The function of slip clutches 58 and 60 is to assist in providing tension forces to applicator pad 24 for the purpose of insuring that complete air bubble free contact is made between applicator pad 24 and one or more surfaces of a film unit such as film unit 36. Slip clutches 58 and 60 operate in the following manner during the fluid application process. When roller select lever 28 is placed in its uppermost position for the purpose of coupling drive motor 14 to forward roller 20 through gear train 26, a lever position signal representative of this uppermost position is routed to sequence controller 40 from lever 28 through path 56. Upon receipt of this uppermost lever position signal, sequence controller 40 transmits a clutch disengage signal to slip clutch 58 through path 62 and a clutch engage signal to slip clutch 60 through path 64. In this mode, tension forces are maintained on applicator pad 24 by the forward web movement producing rotation of roller 20 and the motion retarding friction load applied to reverse roller 22 by slip clutch 60. Conversely, when roller select lever 28 is placed in its lower position for the purpose of coupling drive motor 14 to reverse roller 22 through gear train 26, a lever position signal representative of this lower position is also routed to sequence controller 40 from lever 28 through path 56. Upon receipt of this lower lever-position signal, sequence controller 40 transmits a clutch disengage signal to slip clutch 60 through path 64 and a clutch engage signal to slip clutch 58 through path 62. In this reverse drive mode, tension forces are maintained on applicator pad 24 by the reverse applicator pad movement producing rotation of roller 22 an the motion retarding friction load applied to forward roller 20 by slip clutch 58.

Applicator pad 24 is wrapped on rollers 20 and 22 in the form of an S-curve that can be seen when said web is viewed from the ends of said rollers as shown in drawing FIGS. *2a–2d*. By employing this S-curve configuration, a film unit may be readily directed out through open door 33 and housing cover opening 32 after processing is complete. In addition, wrapping a film unit between adjacent layers of a processing liquid impregnated web applicator in this manner makes possible the simultaneous coating of opposite surfaces of a film unit.

In the preferred embodiment described herein, the processing fluid impregnated in applicator pad 24 is replenished from a reservoir of processing fluid into which a portion of applicator pad 24 has been immersed by means of the wicking or liquid absorbing action of applicator 24 whenever liquid is dispensed from said applicator pad 24 during film unit processing. An alternate though less desirable arrangement for replenishing the liquid dispensed by applicator 24 would be to employ a replacement applicator pad identical to applicator 24, a pad that has previously been impregnated or wetted with processing fluid and subsequently enclosed in a conventional liquid-tight, readily removable foil wrapper. Whenever the processing fluid level in an installed fluid applicator pad is reduced below some minimum acceptable level, the depleted applicator would be replaced by such a foil-enclosed, previously wetted applicator pad.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. Photographic processing apparatus comprising:

a container having an elongated opening through which an exposed film unit may be introduced thereinto, leading edge first;

a pair of elongated rollers rotatably mounted within said container, said rollers being disposed in substantially parallel alignment to each other and to said elongated opening, said rollers further being spaced apart so that an exposed film unit may be introduced into said container in a direction to pass intermediate said rollers; and an elongated fluid applicator pad adapted to be wetted with processing fluid and having its opposite ends connected to respective said rollers and coiled around said rollers in an S-shaped manner so that one side thereof faces inwardly as it passes around a first of said rollers and outwardly as it passes around the second of said rollers, whereby, when the section of said pad immediately extending from said first roller is wetted with fluid and the exposed film unit is introduced into said container so that its leading edge engages said pad intermediate said rollers and said first roller is actuated to effect the coiling of said wetted pad section therearound, the exposed film unit will be coiled around said first roller in face-to-face superposed relationship with said wetted section of said pad, and subsequent actuation of said second roller to effect the coiling of said wetted pad section therearound will effect the advancement of the exposed and now fluid treated film unit outwardly of said container through its said opening, trailing edge first.

2. The apparatus of claim 1 additionally including means associated with each said roller tending to resist its rotation when the other of said rollers is actuated to preclude the formation of air bubbles in the fluid deposited on the film unit as it is coiled around, and subsequently uncoiled from around, said first roller.

3. The apparatus of claim 1 wherein said container is of the type that is liquid-tight and wherein said container opening includes a self-sealing door actuatable between full open and full closed positions to permit the passage of entering and exiting film units therethrough.

4. The apparatus of claim 3 wherein said door functions as a mechanical guide to facilitate movement of said film units through said container opening when actuated to its said full open position.

5. Apparatus for applying a processing fluid to a surface of a sheet of exposed image-containing film unit, comprising:

an enclosure having an opening therein and having means for alternately blocking and unblocking said opening for the movement of a film unit therethrough;

a pair of elongated rollers rotatably mounted within said enclosure with said rollers being disposed adjacent said enclosure opening and in substantially parallel alignment with each other;

a length of process fluid containing applicator pad wrapped on said rollers having each end thereof attached to a respective one of said rollers; and drive means coupled to said rollers for transporting an end of said sheet material from a light-tight cassette through said enclosure opening and into the bite between adjacent wrapped and unwrapped applicator pad layers, for driving said rollers in a forward direction until each surface of said film unit fully contacts a surface of said applicator pad and for subsequently driving said rollers in a film unit movement reversing direction through said enclosure opening and out of said processing apparatus after said film unit has imbibed the proper amount of processing fluid.

6. The apparatus of claim 5, wherein said enclosure is of the type that is liquid-tight and wherein said enclosure contains a quantity of processing fluid, a portion of said applicator pad is immersed in said quantity of processing fluid and fluid dispensed by said applicator pad during the processing fluid application process is replenished from said quantity of fluid by the fluid absorbing action of said applicator pad.

7. The apparatus of claim 6 wherein said applicator pad is wrapped on one of said rollers in one direction and on the other roller in the opposite direction in an S-shaped manner as viewed from either end of said roller pair.

8. The apparatus of claim 1 or 5 wherein said applicator pad is formed of polypropylene.

9. The apparatus of claim 1 or 5 wherein said applicator pad is of the type that is readily interchangeable with an identical applicator pad that has been fully wetted with processing fluid.

10. A method of applying a processing fluid to a surface of an exposed film unit with apparatus having a container with an opening therein, a pair of elongated rollers rotatably mounted within said container with said rollers being disposed adjacent said opening and in substantially parallel alignment with each other and a length of applicator pad wetted with processing fluid, said applicator having opposite ends thereof that are attachable to a respective one of said roller pair, comprising the steps of:

attaching one end of said applicator pad to a first roller and placing a portion of said applicator on said first roller wrapped in a particular direction;

attaching the other end of said applicator pad to a second roller and placing another portion of said applicator on said second roller wrapped in a direction opposite to that of the said applicator portion on said first roller;

coupling a motion-retarding friction load to said second roller;

transporting an end of said exposed film unit through said container opening and into engagement with said applicator pad into the bite between a wrapped portion on said first roller and an unwrapped portion between said first and second rollers;

driving said first roller in a direction that will cause an additional length of applicator pad to be wrapped onto said first roller and thereby cause said sheet material to be drawn in between adjacent wrapped applicator pad layers to the point where each surface of said film unit fully contacts a surface of said applicator pad;

waiting a length of time equal to the time required for the proper amount of processing fluid to be imbibed by said film unit;

uncoupling said motion-retarding friction load from said second roller and coupling a motion-retarding load to said second roller; and driving said second roller in a direction that will cause a length of applicator pad to be wrapped onto said second roller and thereby cause said imbibed film unit to be transported out of said container through said container opening.

11. The method of claim 10 comprising the additional step of periodically rotating said second roller a predetermined rotational distance beyond the point where a fully imbibed film unit has been transported out of said container such that an additional length of applicator pad is wrapped onto said second roller from said first roller to thereby expose fresh unused surfaces of said applicator pad for subsequent processing-fluid application.

12. The method of claim 10 wherein said container is of the type that is liquid-tight and wherein said container opening includes a self-sealing door actuatable between full open and full closed positions with said method comprising the additional steps of actuating said door opening to its full open position before moving said film unit through said container opening and actuating said door to its full closed position after said film unit has been transported into or out of said container through said container opening.

* * * * *